US006789677B2

(12) United States Patent
Maietta

(10) Patent No.: US 6,789,677 B2
(45) Date of Patent: Sep. 14, 2004

(54) CHILD-RESISTANT CONTAINER

(75) Inventor: Michael G. Maietta, Montgomery, PA (US)

(73) Assignee: West Pharmaceutical Services, Inc., Lionville, PA (US)

( * ) Notice: Subject to any disclaimer, the term of this patent is extended or adjusted under 35 U.S.C. 154(b) by 0 days.

(21) Appl. No.: 10/308,335

(22) Filed: Dec. 2, 2002

(65) Prior Publication Data

US 2003/0102321 A1 Jun. 5, 2003

Related U.S. Application Data

(60) Provisional application No. 60/334,409, filed on Nov. 30, 2001.

(51) Int. Cl.[7] ..... B65D 43/16; B65D 85/42; B65D 83/04; A45C 13/10

(52) U.S. Cl. ..... 206/536; 206/528; 206/538; 206/1.5; 220/283; 220/824

(58) Field of Search ..... 206/533, 536, 206/308.1, 309, 310–313, 528, 538, 539, 37, 38, 39.4, 39.5; 220/281, 558, 559, 816, 820, 824, 533, 834, 326, 283; 312/9.16, 9.17, 9.11, 9.47, 9.58, 9.63; 292/332, 334

(56) References Cited

U.S. PATENT DOCUMENTS

| | | | | |
|---|---|---|---|---|
| 1,455,432 | A | | 5/1923 | Dodson |
| 1,460,950 | A | | 7/1923 | Denney |
| 1,910,033 | A | | 5/1933 | Mincovsky |
| 2,327,513 | A | | 8/1943 | Esterow |
| 2,391,347 | A | | 12/1945 | Punte |
| 3,504,788 | A | | 4/1970 | Gray |
| 3,526,351 | A | | 9/1970 | Goldstien |
| 3,894,654 | A | | 7/1975 | Frankenberg |
| 4,511,032 | A | | 4/1985 | Bush |
| 4,730,731 | A | | 3/1988 | Allison |
| 4,741,433 | A | | 5/1988 | Irvine |
| 5,244,084 | A | * | 9/1993 | Chan ..... 206/308.1 |
| 5,413,219 | A | * | 5/1995 | Yu ..... 206/1.5 |
| 5,632,394 | A | | 5/1997 | Mecca et al. |
| 5,785,180 | A | | 7/1998 | Dressel et al. |
| 6,021,901 | A | | 2/2000 | Wolfe |
| 6,041,935 | A | | 3/2000 | Yang |
| 6,247,595 | B1 | | 6/2001 | Omata et al. |
| 6,302,120 | B1 | | 10/2001 | Kuo |
| 6,318,550 | B1 | * | 11/2001 | Giovinazzi ..... 206/308.1 |
| 6,325,241 | B1 | | 12/2001 | Garde et al. |
| 6,345,627 | B1 | | 2/2002 | Petit |

FOREIGN PATENT DOCUMENTS

DE 3832050 A1 * 3/1990 ..... B65D/75/36

* cited by examiner

*Primary Examiner*—Gregory Pickett
(74) *Attorney, Agent, or Firm*—Akin Gump Strauss Hauer & Feld L.L.P.

(57) ABSTRACT

A child-resistant container for holding an item includes a housing and a tray that is pivotably connected to the housing for pivotable movement between a closed position in which the tray is in the housing for preventing access to the item and an open position in which the tray extends out of the housing for exposing the item. A latch in the form of a flexible member is connected to the tray and is biased to engage the housing when the tray is in the closed position. A lock assembly is connected to the housing and is engageable with the tray when the tray is in the closed position. In use, the tray is secured in the closed position by the latch and the lock and is angularly displaceable from the closed position to the open position upon the simultaneous application of a first force to the latch, a second force to the lock and a torque to the tray.

20 Claims, 5 Drawing Sheets

CHILD-RESISTANT CONTAINER

CROSS-REFERENCE TO RELATED APPLICATIONS

This application claims priority from U.S. Provisional Patent Application No. 60/334,409, filed Nov. 30, 2001 and entitled "Child Resistant Container".

BACKGROUND OF THE INVENTION

The present invention relates to a child-resistant container and more specifically to a child-resistant container for storing a blister pack having an arrangement of blisters each of which contains a tablet or capsule.

Many pharmaceutical products such as tablets and capsules are packaged in blister packs to deter children from obtaining and ingesting the products. The designer of such blister packs is confronted with conflicting requirements. The blister pack must be child-resistant and at the same time able to be opened without unreasonable difficulty. Typical blister packs are known to be difficult for some adults to open while still failing to be a deterrent for unsupervised children.

A child-resistant container for storing blister packs provides a second layer of safety. To be effective the container should require a degree of perception and manual dexterity above the abilities of unsupervised children attempting to gain access to the contents of the blister pack and should also be easy for adults to use. A container requiring the coordinated use of both hands and the simultaneous application of a force to both a latch and a lock assembly to gain access to the blister pack, such as the container of the invention disclosed herein, should provide the requisite level of protection.

SUMMARY OF THE INVENTION

In accordance with one aspect of the invention, a child-resistant container for holding at least one item includes a housing having upper and lower walls and at least one open side between the upper and lower walls and a tray that is pivotably connected to the housing at a pivot joint. The tray is adapted for holding at least one item and is pivotable between a first position in which the tray is in the housing for preventing access to the at least one item and a second position in which the tray extends through the at least one open side of the housing for exposing the at least one item. A latch comprising a flexible member is connected to the tray. The flexible member is biased into engagement with the housing when the tray is in the first position. A lock assembly is engageable with the tray when the tray is in the first position. In use, the tray is secured in the first position by the latch and the lock and is angularly displaceable from the first position to the second position upon the simultaneous application of a first force to the latch, a second force to the lock and a torque to the tray.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
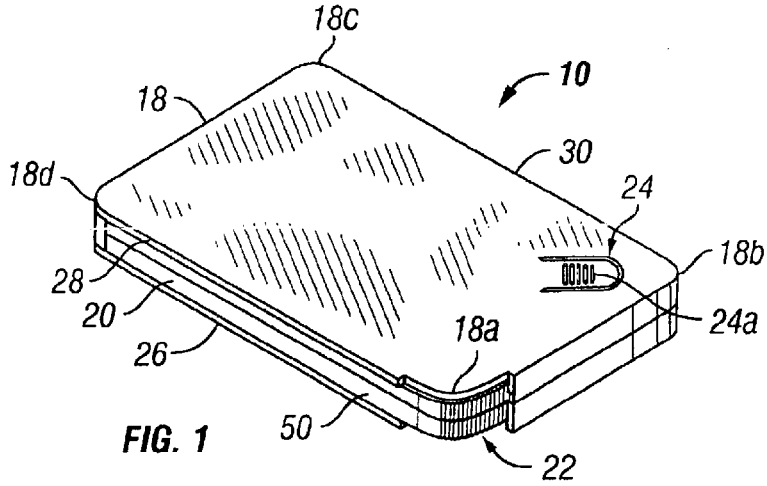
FIG. 1 is a top perspective view of a child-resistant container in accordance with a preferred embodiment of the present invention

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the child-resistant container and designated parts thereof. The terminology includes the words above specifically mentioned, derivatives thereof, and words of similar import.

Referring to the drawings in detail, wherein like numerals indicate like elements throughout, there is shown in FIGS. 1–7 a preferred embodiment of a child-resistant container 10 in accordance with the present invention. The container 10 is for containing a blister pack (not shown) having an arrangement of blisters, each containing a tablet or capsule.

Those having ordinary skill in the art will appreciate from this disclosure that contents or items other than tablets or capsules can be contained in the container 10 of the present invention. For example, liquid or granular pharmaceuticals, contact lenses suspended in liquid or similar items potentially hazardous to children or adults can be safely contained in a readily accessible and convenient manner using the container 10 of the present invention. Accordingly, while the preferred container 10 is discussed below as having a tray 20 for holding a blister pack, those having ordinary skill in the art will appreciate from this disclosure that the present invention is not limited to containers for containing blister packs.

Thus, the container 10 can be used to contain other contents without departing from the scope of the present invention. The necessary changes to the container 10 to accommodate contents other than a blister pack would be obvious to one of ordinary skill in the art when considered in combination with this disclosure. Accordingly, for brevity, the below disclosure is directed to a container 10 for blister packs having an arrangement of tablets with the understanding that the invention is not limited to containing blister packs or tablets.

Referring to FIGS. 1–3 and 6, the container 10 includes a housing 18, a tray 20, a latch 22, and a lock assembly 24.

The housing 18 has a generally rectangular shape. However, those of skill in the art will appreciate from this disclosure that the container 10 of the present invention is not limited to a container having a housing of any particular shape. For example, the housing 18 may be cylindrically shaped, triangularly shaped, cubically shaped or the like without departing from the scope of the present invention. Preferably, the rectangular-shaped housing 18 has first, second, third, and fourth corners 18*a*, 18*b*, 18*c*, 18*d*, each of which has a generally arcuate shape. The first corner 18*a* preferably has a radius of curvature greater than the second, third and fourth corners 18*b*, 18*c*, 18*d* and is adjacent to the second and fourth corners 18*b*, 18*d*. As will be discussed further below, those having ordinary skill in the art will understand that the first corner 18*a* having the greater radius of curvature enables a user to readily ascertain the orientation of the container 10. The artisan will also understand that there are numerous other methods that may be employed to enable the user to determine the orientation of the container 10, such as a faceted corner or the use of a textured surface. Thus the invention is not limited to the use of generally arcuate corners, one of which having a distinguishable difference in its radius of curvature over others, as the sole method for determining orientation.

Figure 2:
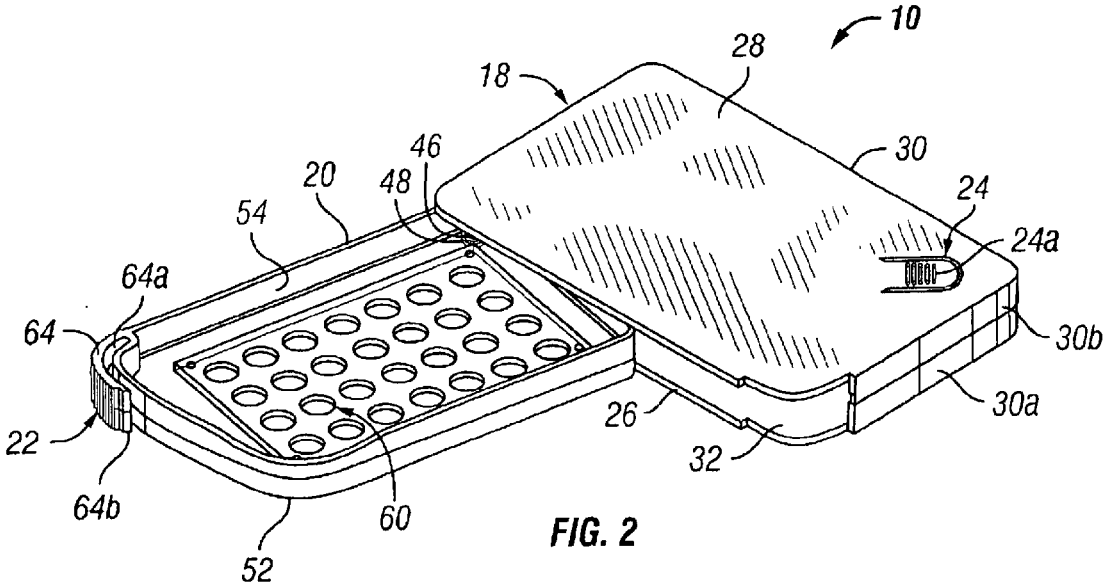
FIG. 2 is a top perspective view of the child-resistant container in FIG. 1 showing the tray in the second (open) position.
Figure 4:
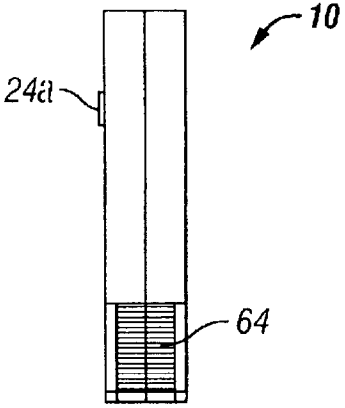
FIG. 4 is a right side elevation view of the child-resistant container in FIG. 3.
Figure 3:
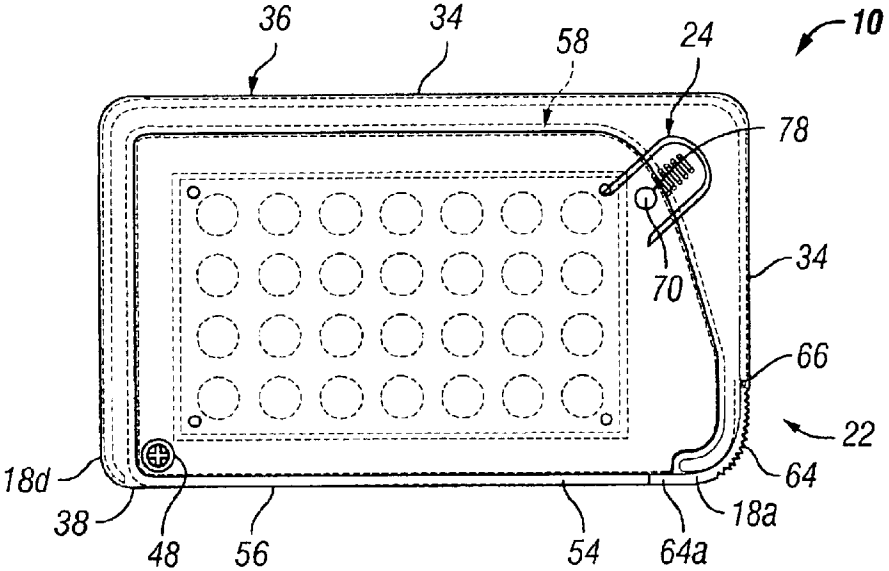
FIG. 3 is a top plan view of the child-resistant container in FIG. 1.
Figure 5:
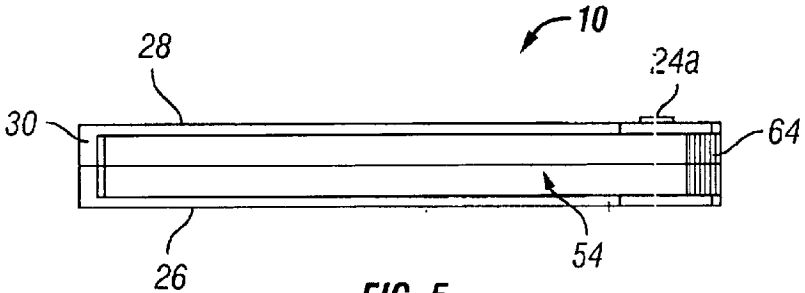
FIG. 5 is a front elevation view of the child-resistant container in FIG. 3.
Figure 6:
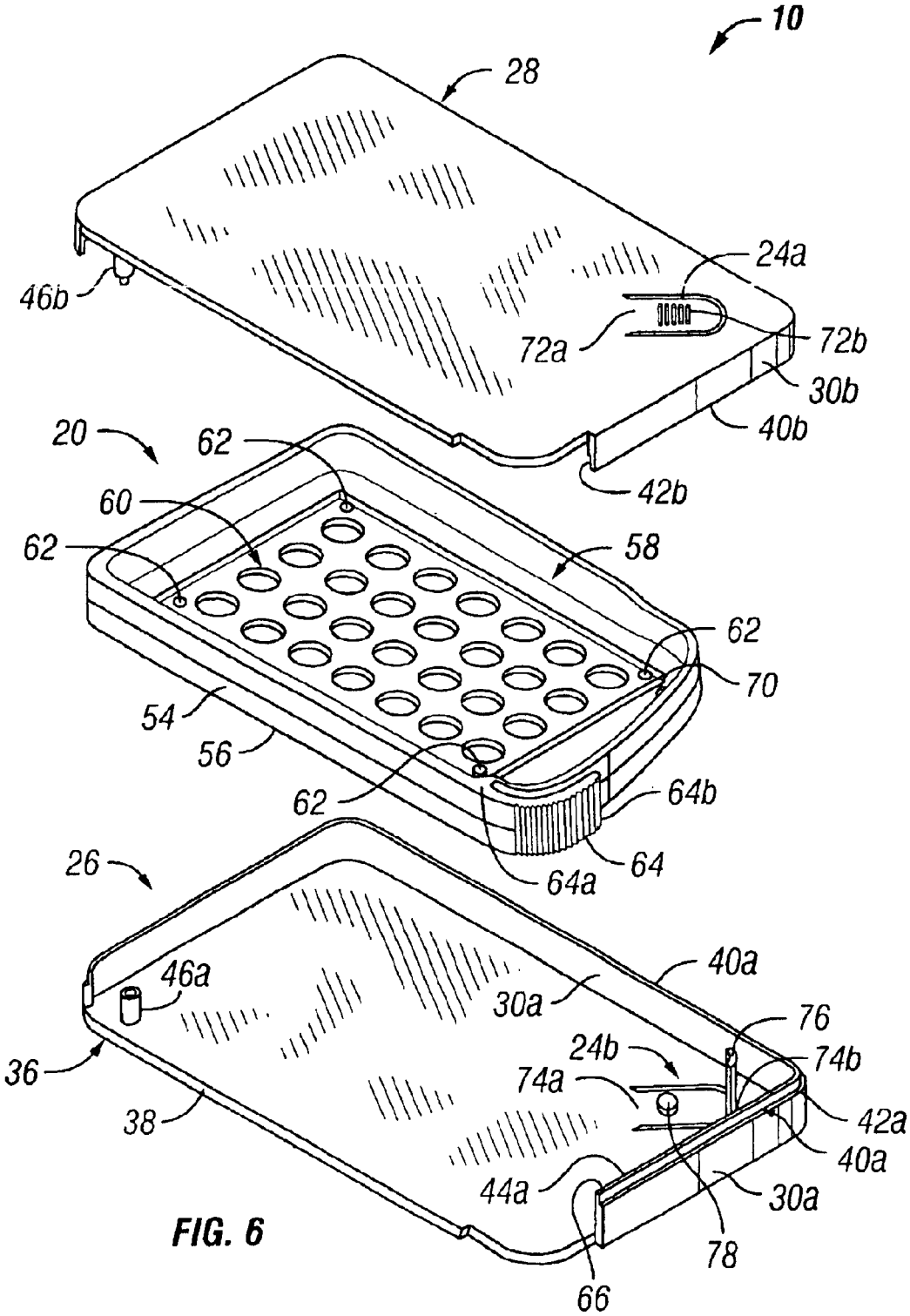
FIG. 6 is an exploded top perspective view of the child-resistant container in FIG. 1.

Referring to FIGS. 2–3 and 6, the housing 18 has a base 26, a top 28, at least one closed side 30 and at least one open side 32. The at least one closed side 30 extends between the base 26 and the top 28 along a first portion 34 of a perimeter 36 of the base 26. The at least one open side 32 extends between the base 26 and the top 28 along a second portion 38 of the perimeter 36 of the base 26 and at least from the fourth corner 18*d* to the first corner 18*a*. Preferably the at least one closed side 30 comprises a base component 30*a* and a top component 30*b*. The base component 30*a* extends upwardly from the base 26 and the top component 30*b* extends downwardly from the top 28. The top edge 40*a* of the base component 30*a* of the at least one closed side 30 has a rabbet 42*a* with an outwardly projecting lip 44*a*. The bottom edge 40*b* of the top component 30*b* of the at least one closed side 30 has a rabbet 42*b* with an inwardly projecting lip (not shown) for mating in a snap fit connection with the corresponding rabbet 42*a* and lip 44*a* of the top edge 40*a* of the at least one closed side 30.

Those having ordinary skill in the art will understand from the present disclosure that the base component 30*a* and the top component 30*b* of the at least one closed side 30 are preferably formed as an integral part of the base 26 and top 28, respectively. The artisan also will understand that the base component 30*a* and the top component 30*b* may be secured to each other by a variety of other well known fastening methods such as an interference fit, screws, adhesives or the like. Further, the artisan will understand that the base component 30*a* and the top component 30*b* need not be formed as an integral part of the base 26 and top 28, respectively, but rather may be separate structures secured to the base 26 and top 28, respectively, by the methods discussed above without departing from the spirit and scope of the invention.

A pivot 46 extends between the base 26 and the top 28 through the tray 20 as discussed below. The pivot 46 is preferably positioned proximal to the fourth corner 18*d* of the housing 18 and comprises a first cylindrical structure 46*a* and a second cylindrical structure 46*b*. The first cylindrical structure 46*a* is integral with the base and extends upwardly from the base 26. The second cylindrical structure 46*b* is integral with the top 28, extends downwardly from the top 28 and engages the first cylindrical structure 46*a* in peg-in-hole like union. Those skilled in the art will understand from this disclosure that the pivot 46 may be any of a variety of well known connectors that provide for angular displacement between to the connected structures, such as a hinge, without departing from the spirit and scope of the invention.

The tray 20 preferably has a shape that generally corresponds to the shape of the base 26 and is preferably generally rectangular in shape. The tray 20 is pivotably connected to the housing 18. Preferably the tray 20 has a pivot hole 48 therethrough that is journaled with the pivot 46. The tray 20 is pivotable between a first (or closed) position 50 (FIG. 1) in which the tray 20 is in the housing 18 and a second (or open) position 52 (FIG. 2) in which the tray 20 extends through the at least one open side 32 of the housing 18. The tray 20 has at least one side 54 that extends upwardly along a first portion 56 of the perimeter 58 of the tray 20 and that corresponds to the at least one open side 32 of the housing 18. Those having ordinary skill in the art will understand from this disclosure that the at least one side 54 preferably, but not necessarily, extends around the entire perimeter 58 of the tray 20. The tray 20 additionally has a plurality of access holes 60 for providing access to the corresponding arrangement of blisters of the blister pack securable to the tray 20 by a plurality of pins 62 integral with the tray 20 and extending upwardly therefrom.

Figure 3A:
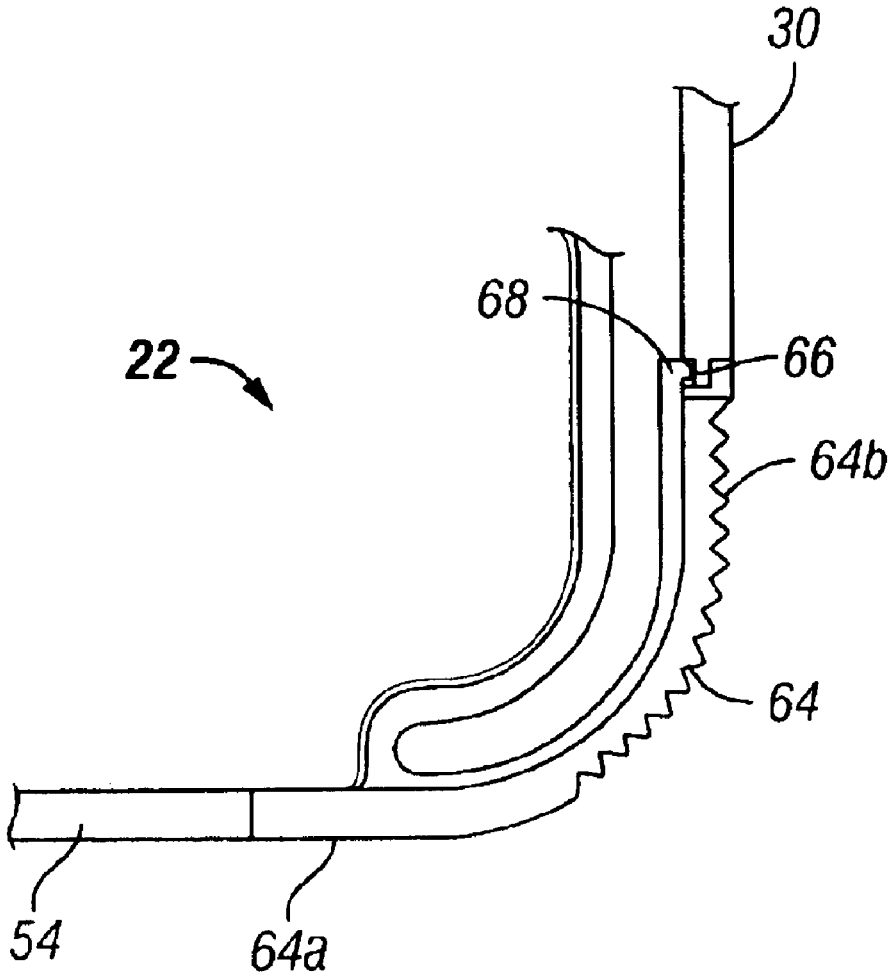
FIG. 3*a* is a greatly enlarged view of a portion of FIG. 3 showing the latch assembly.

Referring to FIGS. 3, 3*a* and 6, the latch 22 comprises a flexible member 64 associated with the tray 20 and a notch 66 associated with the housing 18. The flexible member 64 has a first end 64*a* that is integral with the at least one side 54 of the tray 20 and a second end 64*b* that has an outwardly projecting tang 68. The flexible member 64 is elastically biased outwardly. The notch 66 is in an inwardly facing surface of the at least one closed side 30 of the housing 18. The notch 66 is proximal to the first corner 18*a* of the housing and is positioned for releasably engaging the tang 68 when the tray 20 is in the first position 50 (FIG. 1). The outwardly facing surface of the latch 22 preferably, but not necessarily, is a textured surface. Those skilled in the art will understand from the present disclosure that the latch 22 may be one of a variety of well known latching devices, such as a slider or a snap without departing from the spirit and scope of the invention.

Referring to FIGS. 3 and 6, the lock assembly 24 is connected to the housing 18 and is engageable with a security aperture 70 in the tray 20 when the tray 20 is in the first position 50 (FIG. 1). The lock assembly 24 preferably comprises a flexible upper tab 24*a* and a flexible lower tab 24*b*. The upper tab 24*a* is preferably formed from a partial cutout in the top 28 and has a first end 72*a* integral with the top 28 of the housing 18 and a second free end 72*b*. The upper tab 24*a* is elastically biased outwardly and displaceable inwardly. The lower tab 24*b* is preferably formed from a partial cutout in the base 26 of the housing 18 and has a first end 74*a* integral with the base 26 and a second free end 74*b*. The lower tab 24*b* is elastically biased inwardly and displaceable outwardly. An upwardly extending push rod 76 is integral with the lower tab 24*b* proximal to the second free end 74*b* and engages the upper tab 24*a*. An upwardly extending security boss 78 spaced from the push rod 76 is also integral with the lower tab 24*b* and is positioned for removable insertion into the security aperture 70 in the tray 20, when the tray 20 is in the first position 50. Those skilled in the art will understand from the present disclosure that other methods may be used to lock the tray 20 in the first position 50 such an outwardly biased bolt slideable within a bore in the top 28 of the housing 18 without departing from the spirit and scope of the present invention.

Figure 8:
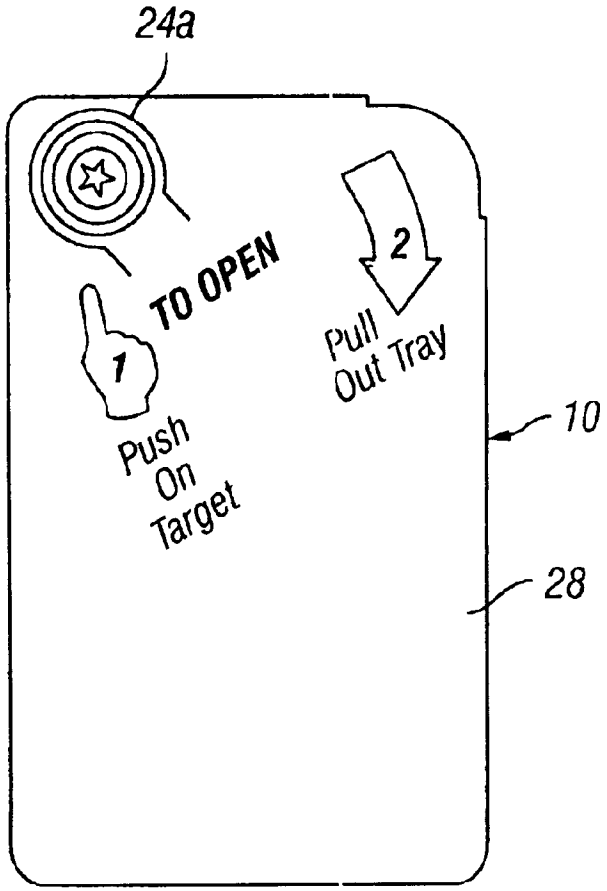
FIG. 8 is a partial top plan view of the child-resistant container in FIG. 1, showing another preferred ornamental design for the top of the housing.
Figure 7:
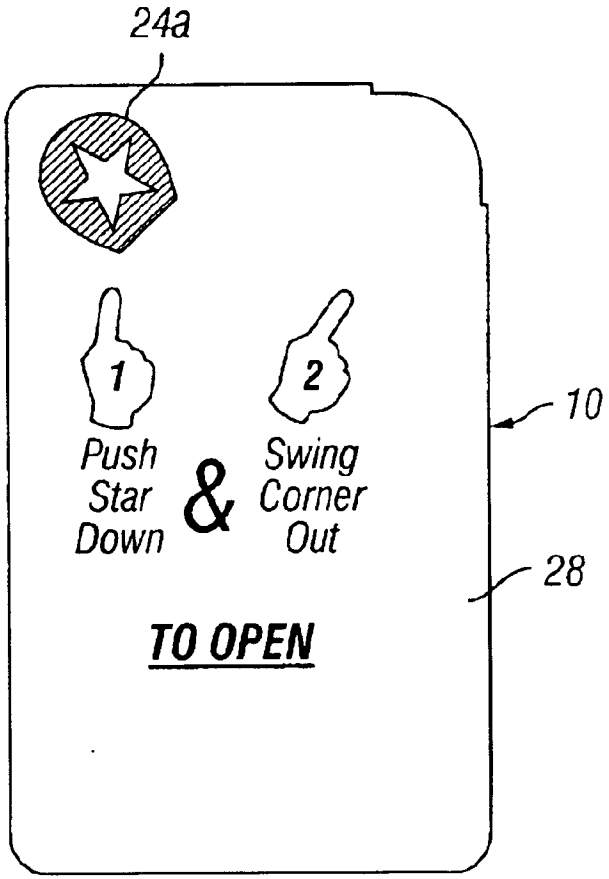
FIG. 7 is a top plan view of the child-resistant container in FIG. 1 showing a preferred ornamental design for the top of the housing.

Referring to FIGS. 7–8, the upper tab 24*a* preferably has an ornamental design such as a star or a target applied to its outer surface as depicted in the referenced figures to direct the user's attention to the location of the upper tab 24*a* on the container 10. Additionally, preferably, but not necessarily, the top 28 of the container 10 may bear markings such as the markings shown in FIGS. 7–8 providing guidance to the user regarding how to operate the device.

Those having ordinary skill in the art will understand from the above disclosure that the tray 20 is secured in the first position 50 by the latch 22 and the lock assembly 24 and is angularly displaceable from the first position 50 toward the second position 52 upon the simultaneous application of an inwardly directed force to the flexible member 64 of the latch 22 and upper tab 24*a* of the lock assembly and a torque to the tray.

Preferably, but not necessarily, the above-disclosed components of the container 10 are fabricated from die-formable polymeric materials. However, a wide variety of well-known materials including but not limited to metals such as aluminum or stainless steel may be used without departing from the scope and spirit of the invention.

The container 10 is preferably ergonomically designed for simplicity of use as follows. The container 10 with the tray 20 in the first or closed position 50 grasps the container 10 in the left hand with the at least one closed side 30 facing the palm of the user's hand, the top 28 facing upwardly and the left thumb placed over the upper tab 24*a* of the lock assembly 24. The index finger of the user's right hand is placed on the flexible member 64 of the latch 22. To open the container 10, the user simultaneously applies with the left thumb and right index finger an inwardly directed force to the upper tab 24*a* and the flexible member 64 respectively and a torque to the tray 20. The force applied to the upper tab 24*a* causes the upper tab 24*a* to be displaced inwardly and thereby transfer the force to the push rod 76 of the lower tab 24*b* which, in turn, is displaced downwardly and outwardly to withdraw the security boss 78 from the security aperture 70 and unlock the tray 20.

The application of the inwardly directed force to the flexible member 64 causes an inward displacement of the flexible member 64, which in turn causes the withdrawal of the tang 68 from the notch 66 in the at least one closed side 30 of the housing 18. The simultaneous withdrawal of the security boss 78 and the tang 68 frees the tray 20 for angular displacement about the pivot 46. With both the upper tab 24*a* and the flexible member 64 inwardly displaced, the application of the torque to the tray 20 pivots the tray 20 form the first (closed) position 50 to the second (open) position 52.

When the tray 20 is in the open position 50, the user may either place a new blister pack in the tray 20 and secure it in position with the blister pack retention pins 62, remove a tablet from a blister of an already contained blister pack, or replace an already present blister pack with another.

The application of a reverse torque to the tray 20 returns the tray 20 to the closed position 50. When the tray 20 is returned to the closed position 50, in the absence of the force applied to the upper tab 24*a* and the flexible member 64, the tang 68 is inserted in the notch 66 and the security boss 78 is inserted in the security aperture 70 due to the biased positioning of the latch 22 and the lock assembly 24.

Those skilled in the art will appreciate that changes could be made to the embodiments described above without departing from the broad inventive concept thereof. By way of example, although the container 10 has been described for use with a single blister pack layer or the like, the container 10 may be arranged in a stacked configuration to accommodate a plurality of trays 20. It is understood, therefore, that this invention is not limited to the particular embodiments disclosed, but it is intended to cover modifications within the spirit and scope of the present invention as defined by the appended claims.

I claim:

1. A child-resistant container for holding at least one item, the container comprising:

a housing having upper and lower walls and at least one open side between the upper and lower walls;

a tray adapted for holding at least one item, the tray being pivotably connected to the housing at a pivot joint for movement between a first position in which the tray is in the housing for preventing access to the at least one item and a second position in which the tray extends through the at least one open side of the housing for exposing the at least one item;

a first locking mechanism comprising a flexible member connected to the tray, the flexible member being biased into engagement with the housing when the tray is in the first position; and a second locking mechanism separate from the first locking mechanism and engageable with the tray when the tray is in the first position;

wherein the tray is secured in the first position by the first locking mechanism and the second locking mechanism and is angularly displaceable from the first position to the second position upon the simultaneous application of a first force to the first locking mechanism, a second force to the second locking mechanism and a torque to the tray.

2. A child-resistant container according to claim 1, wherein the housing further includes a notch and the first locking mechanism further includes a tang that is engageable with the notch when the tray is in the first position.

3. A child-resistant container according to claim 2, wherein the notch is located in a side wall of the housing adjacent the at least one open side.

4. A child-resistant container for holding at least one item, the container comprising:

a housing having upper and lower walls, at leant one open side between the upper and lower walls and a notch that is located in a side wall of the housing adjacent the at least one open side;

a tray adapted for holding at least one item, the tray being pivotably connected to the housing at a pivot joint for movement between a first position in which the tray is in the housing for preventing access to the at least one item and a second position in which the tray extends through the at least one open side of the housing for exposing the at least one item;

a latch comprising a flexible member connected to the tray, the flexible member being blind into engagement with the housing when the tray is in the first position, the latch including a tang that is engageable with the notch of the housing when the tray it in the first position; and a lock assembly engageable with the tray when the buy is in the first position, the lock assembly including a first flexible tab integral with one of the upper and lower walls of the housing and a boss extending from the first tab for locking engagement with the tray when the tray is in the first position;

wherein the tray is secured in the first position by the latch and the look assembly and is angularly displaceable from the first position to the second position upon the simultaneous application of a first force to the latch, a second force to the lock assembly and a torque to the tray.

5. A child-resistant container according to claim 4, wherein the lock assembly further comprises a second flexible tab integral with the other of the upper and lower walls of the housing and a push rod extending from the first tab to the second tab, such that inwardly directed force applied so the second tub causes outward flexion of the first tab from the one wall and simultaneous disengagement of the boss from the tray to thereby release the tray from the first position.

6. A child-resistant container according to claim 5, wherein the tray has a security aperture through which the boss extends, when the tray is in the first position.

7. A child-resistant container according to claim 1, wherein the locking mechanism includes a first flexible tab integral with one of the upper and lower walls of the housing and a boss extending from the first tab for locking engagement with the tray when the tray is in the first position.

8. A child-resistant container according to claim 7, wherein the second locking mechanism further includes a second flexible tab integral with the other of the upper and lower walls of the housing and a push rod extending from the first tab to the second tab, such that an inwardly directed force applied to the second tab causes outward flexion of the first tab from the one wall and simultaneous disengagement of the boss from the tray to thereby release the tray from the first position.

9. A child-resistant container according to claim 7, wherein the tray has a security aperture through which the boss extends when the tray is in the first position.

10. A child-resistant container according to claim 1, wherein the housing and the tray are generally rectangular in shape.

11. A child-resistant container according to claim 10, wherein the pivot joint is adjacent a first corner of the housing.

12. A child-resistant container according to claim 11, wherein the second locking mechanism is adjacent a second corner of the housing that is diagonal to the first corner.

13. A child-resistant container according to claim 12, wherein the flexible member of the first locking mechanism is located at a third corner of the housing when the tray is in the first position.

14. A child-resistant container according to claim 13, wherein the first locking mechanism is integral with the tray.

15. A child-resistant container according to claim 13, wherein the housing further includes a notch and the first locking mechanism further includes a tang that is engageable with the notch when the tray is in the first position.

16. A child-resistant container according to claim 15, wherein the notch is located in a side wall of the housing adjacent the at least one open side.

17. A child-resistant container according to claim 13, wherein the second locking mechanism further includes a first flexible tab integral with one of the upper and lower walls of the housing and a boss extending from the first tab for locking engagement with the tray when the tray is in the first position.

18. A Child-resistant container according to claim 17, wherein the second locking mechanism further includes a second flexible tab integral with the other of the upper mad lower walls of the housing and a pushrod extending from the first tab to the second tab, such that an inwardly directed force applied to the second tab causes an outward flexion of the first tab from the one wall and simultaneous disengagement of the boss from the tray to thereby release the tray from the first position.

19. A child-resistant container according to claim 18, wherein the tray has a security aperture through which the boss extends when the tray is in the first position.

20. A child-resistant container according to claim 1, wherein the first locking mechanism is integral with the tray.

* * * * *

UNITED STATES PATENT AND TRADEMARK OFFICE

CERTIFICATE OF CORRECTION

PATENT NO. : 6,789,677 B2
APPLICATION NO. : 10/308335
DATED : September 14, 2004
INVENTOR(S) : Michael G. Maietta It is certified that error appears in the above-identified patent and that said Letters Patent is hereby corrected as shown below:

Column 6:
Line 42, “leant” should read -- least --;
Line 54, “blind” should read -- biased --;
Line 57, “tray it in” should read -- tray is in --;
Line 59, “buy” should read -- tray --;
Line 67, “look” should read -- lock --;

Column 7:
Line 10, “applied so” should read -- applied to --;
Line 16, the comma after “extends” should be deleted;
Line 18, -- second -- should be inserted after “wherein the”;

Column 8:
Line 24, “Child-resistant” should read -- child-resistant --;
Line 26, “mad” should read -- and --.

Signed and Sealed this

Eleventh Day of November, 2008

JON W. DUDAS
*Director of the United States Patent and Trademark Office*